US007058512B2

(12) United States Patent
Downton

(10) Patent No.: US 7,058,512 B2
(45) Date of Patent: Jun. 6, 2006

(54) DOWNHOLE RATE OF PENETRATION SENSOR ASSEMBLY AND METHOD

(75) Inventor: Geoff Downton, Minchinhampton (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/072,168

(22) Filed: Mar. 4, 2005

(65) Prior Publication Data

US 2005/0197778 A1 Sep. 8, 2005

(30) Foreign Application Priority Data

Mar. 4, 2004 (GB) ..... 0404850.0

(51) Int. Cl.
*G01V 1/40* (2006.01)
*G01V 3/18* (2006.01)
*G01V 5/04* (2006.01)

(52) U.S. Cl. ..... 702/9

(58) Field of Classification Search ..... 702/9
See application file for complete search history.

(56) References Cited

U.S. PATENT DOCUMENTS 6,769,497 B1 8/2004 Dubinsky et al. ..... 175/27
2002/0167332 A1 11/2002 Bernstein et al. ..... 326/36

FOREIGN PATENT DOCUMENTS

GB 2 411 726 * 7/2005

* cited by examiner

*Primary Examiner*—Michael Nghiem
(74) *Attorney, Agent, or Firm*—Jennie Salazar; Victor H. Segura; Dale V. Gaudier

(57) ABSTRACT

Methods and apparatuses to determine the rate of penetration of a subterranean drilling assembly into a formation are disclosed. The methods and apparatuses generate rate of penetration by integration axial acceleration data with respect to time and applying a correction factor. The correction factor, meant to account for the effect of gravity on the acceleration data, is determined when rotational velocity of the drilling assembly relative to the formation is zero.

19 Claims, 2 Drawing Sheets

DOWNHOLE RATE OF PENETRATION SENSOR ASSEMBLY AND METHOD

CROSS-REFERENCE TO RELATED APPLICATIONS

This application claims priority to UK Application No. 0404850.0 filed on Mar. 4, 2004.

BACKGROUND OF THE INVENTION

The present invention generally relates to apparatus and methods to measure the rate of penetration (ROP) of a bottom hole assembly (BHA) into a subterranean formation. More particularly, the present invention relates to measuring the rate of penetration of a bottom hole assembly into a subterranean formation using accelerometers. More particularly still, the present invention relates to accurately measuring the rate of penetration with accelerometers using an advanced calibration and zeroing apparatus and method.

Boreholes are frequently drilled into the Earth's formation to recover deposits of hydrocarbons and other desirable materials trapped beneath the Earth's crust. Traditionally, a well is drilled using a drill bit attached to the lower end of what is known in the art as a drillstring. The drillstring is a long string of sections of drill pipe that are connected together end-to-end through rotary threaded pipe connections. The drillstring is rotated by a drilling rig at the surface thereby rotating the attached drill bit. The weight of the drillstring typically provides all the force necessary to drive the drill bit deeper, but weight may be added (or taken up) at the surface, if necessary. Drilling fluid, or mud, is typically pumped down through the bore of the drillstring and exits through ports at the drill bit. The drilling fluid acts both lubricate and cool the drill bit as well as to carry cuttings back to the surface. Typically, drilling mud is pumped from the surface to the drill bit through the bore of the drillstring, and is allowed to return with the cuttings through the annulus formed between the drillstring and the drilled borehole wall. At the surface, the drilling fluid is filtered to remove the cuttings and is often recycled.

In typical drilling operations, a drilling rig and rotary table are used to rotate a drillstring to drill a borehole through the subterranean formations that may contain oil and gas deposits. At downhole end of the drillstring is a collection of drilling tools and measurement devices commonly known as a Bottom Hole Assembly (BHA). Typically, the BHA includes the drill bit, any directional or formation measurement tools, deviated drilling mechanisms, mud motors, and weight collars that are used in the drilling operation. A measurement while drilling (MWD) or logging while drilling (LWD) collar is often positioned just above the drill bit to take measurements relating to the properties of the formation as borehole is being drilled. Measurements recorded from MWD and LWD systems may be transmitted to the surface in real-time using a variety of methods known to those skilled in the art. Once received, these measurements will enable those at the surface to make decisions concerning the drilling operation. For the purposes of this application, the term MWD is used to refer either to an MWD (sometimes called a directional) system or an LWD (sometimes called a formation evaluation) system. Those having ordinary skill in the art will realize that there are differences between these two types of systems, but the differences are not germane to the embodiments of the invention.

An increasingly popular form of drilling is called "directional drilling." Directional drilling is the intentional deviation of the wellbore from the path it would naturally take. In other words, directional drilling is the steering of the drill string so that it travels in a desired direction. Directional drilling is advantageous offshore because it enables several wells to be drilled from a single platform. Directional drilling also enables horizontal drilling through a reservoir. Horizontal drilling enables a longer length of the wellbore to traverse the reservoir, which increases the production rate from the well.

When drilling subterranean wellbores, it is often desirable for the operator to know the rate of penetration (ROP) of the drillstring into the formation for any particular instance. If the measurement is taken at the drill bit, ROP can be a direct measure of how much progress the drilling apparatus is making in a particular formation. As there is much variability among subterranean formations, the rate of penetration for a particular drilling apparatus is expected to change over time.

In addition to its primary use as a measure of success in drilling, operators may also use ROP to determine changes in the formation, wear on the drilling apparatus, and data collection triggering for MWD tools. An accurate, at-the-bit, time-delimited measurement of ROP can help operators identify formation transitions. For example, if ROP is measured at 30 inches per hour at one depth and 40 inches per hour at another depth, operators can use that change In ROP to estimate a change in relative hardness of the formation between the two recorded depths. Furthermore, if ROP measurements gradually (or suddenly) drop as a wellbore is drilled, operators at the surface can use the data received to determine whether the drill bit has become substantially worn, necessitating replacement.

Finally, an accurate measure of ROP is advantageous for MWD operations as well. Most MWD operations require the collection (and storage) of large amounts of data. Often this data would be too voluminous if transmitted continuously, therefore sampling at time-delimited intervals is typically employed. With an accurate measure of ROP, an MWD operator can set the data acquisition interval to maximize the benefit of the measurements. If the ROP is slow, data measurements taken at short intervals waste telemetry bandwidth. In contrast, measurements taken too infrequently would not yield a complete data set. Therefore, the use of an accurate ROP measurement enables optimized MWD operations that get the most utility from a limited telemetry bandwidth.

Because ROP is typically reported in feet per hour, it is often difficult to estimate actual ROP at the drill bit from the surface. Traditionally, ROP measurements were made at specified intervals by measuring the amount of drill pipe paid out at the surface over said intervals. Because a typical drillstring can be several thousand feet long, ROP measurements made at the surface rarely correlate to the actual rate of penetration experienced by the drill bit. Drillstrings over several thousand feet in length act as elastic members and can stretch and hang-up at various points along their length, making surface ROP measurements estimates, at best.

One method that has been employed to determine at-the-bit ROP has been through the use of accelerometers. Accelerometers have been used, with limited success, to determine the acceleration along the axis of the drill bit downhole. This acceleration data is then integrated to yield a velocity along the axis of the drill bit. The accuracy of these types of measurements leave much to be desired. Primarily, during drilling, the bit assembly undergoes significant vibrations and other associated movements as the formation is cut. Furthermore, with directional drilling technology being quite advanced, the component of gravity will have a different effect on the error component of the accelerometer as the drillstring is drilled further into the formation. For this reason, the error component of the accelerometer in the bit axis will change over time. Furthermore, the process is made even more difficult by the relatively low velocities (on the order of inches per hour) that are to be detected by the accelerometer. Left unchecked, the undesired components experienced by the bit axis accelerometer can dominate the reading, leaving little chance for an accurate ROP extrapolation. A more accurate at-the-bit ROP measurement apparatus and method would be highly desirable.

BRIEF SUMMARY OF THE INVENTION

The deficiencies of the prior art are addressed by an apparatus and a method to perform a corrected rate of penetration calculation for a downhole drilling assembly. The present invention accomplishes this task using an apparatus or method to generate a gravity correction factor when the rotation of a drill bit of the drilling assembly is zero relative to the formation. The correction factor is then used to calculate a rate of penetration by integrating acceleration data from a downhole accelerometer from an axis of interest. The factor is then used to correct a rate of penetration calculated by integrating acceleration data from a downhole accelerometer from an axis of interest.

BRIEF DESCRIPTION OF THE DRAWINGS

For a more detailed description of the preferred embodiments of the present invention, reference will not be made to the accompanying drawings, wherein.

DETAILED DESCRIPTION OF THE PREFERRED EMBODIMENTS

Figure 1:
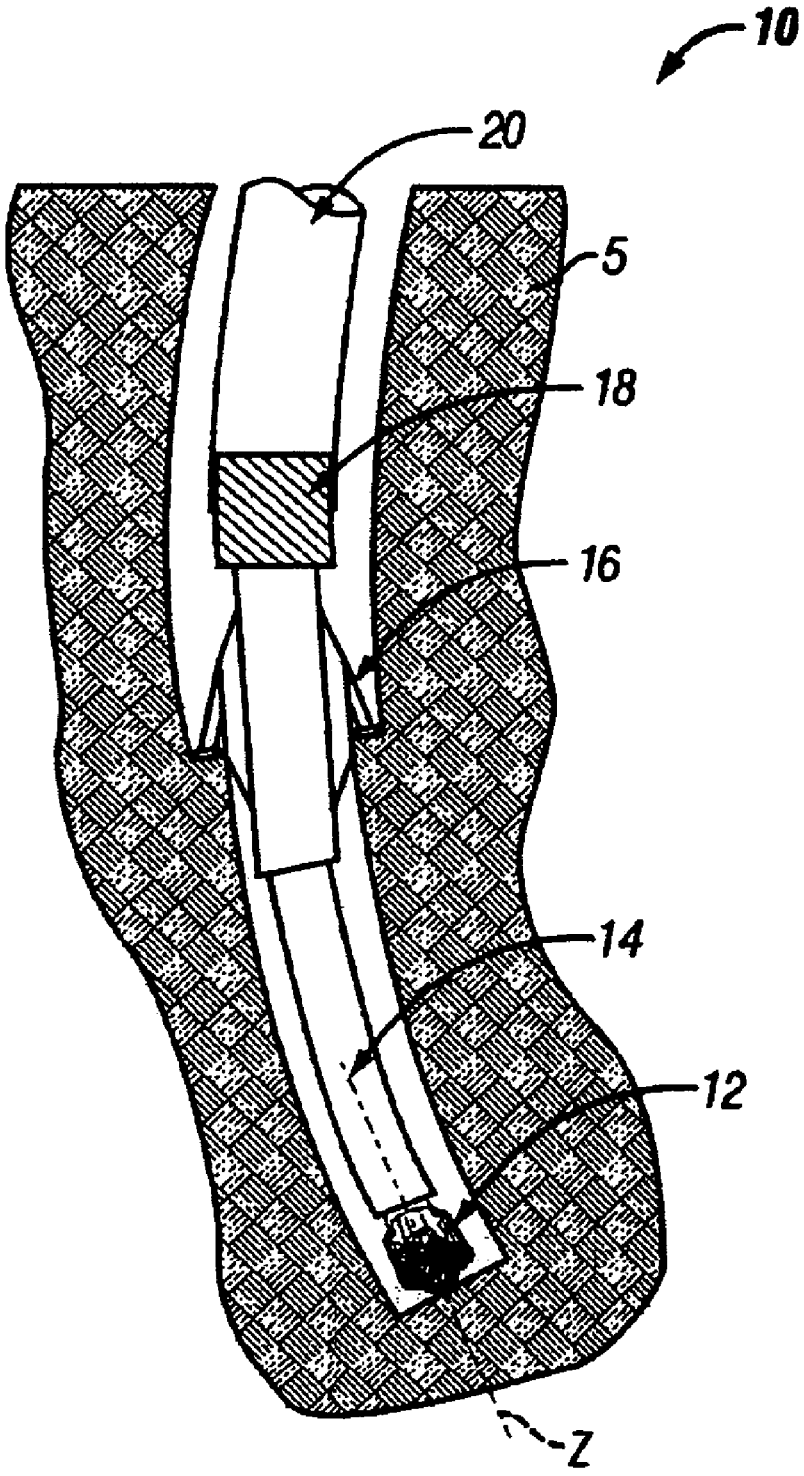
FIG. 1 is a schematic representation of a subterranean drilling system shown engaging a formation.

Referring initially to FIG. 1, a typical subterranean drilling system 10 is schematically shown engaging a formation 5. While directional drilling system 10 is shown as a directional drilling system, any drilling system known to one skilled in the art may be used in conjunction with the present invention. Directional drilling system 10 includes a drill bit 12, a directional drilling assembly 14, an underreamer 16, and a connection 18 to a drillstring 20. Typically, drilling is effectuated through the rotation of drillstring 20 which in-turn rotates drill bit 12. The rotation of drill bit 12 in conjunction with the addition of weight upon drill bit 12 enables drilling system 10 to advance deeper into formation 5. Drilling fluid (not shown) is transmitted through the bore of the drillstring 20 and drilling assembly 10 to ports (not shown) of drill bit 12 where the fluids lubricate and clean the cutting surfaces of drill bit 12. Following expulsion through bit 12, drilling fluids are allowed to flow back to the surface through the annulus formed between the outside of drillstring 20 and formation 5. Drill bit 12 penetrates formation 5 through rotation of bit 12 relative to formation 5. The rate of penetration of drill bit 12 into formation 5 is of particular significance. Typically, the rate of penetration is measured along a penetration axis Z, an axis orthogonal to the plane of rotation of bit 12. Axis Z represents the instantaneous "heading" of drilling apparatus 10 and rate of penetration on axis Z is important to directional drilling operators. While axis Z is shown as the instantaneous heading of drilling assembly 10 and is generally orthogonal to the plane of bit 12 rotation, it should be understood by one of ordinary skill in the art that any axis of investigation may be employed.

Figure 2:
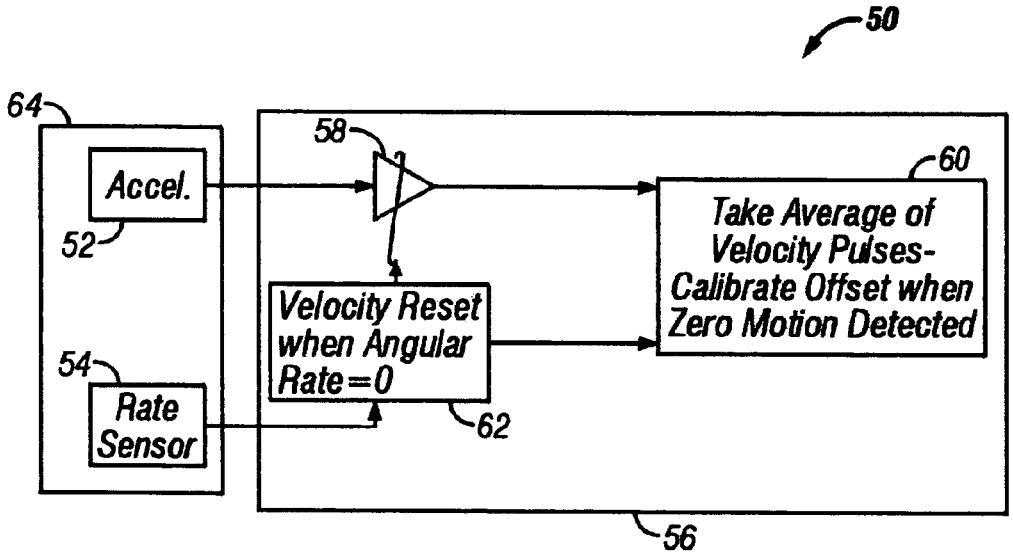
FIG. 2 is a schematic block diagram of a rate of penetration sensor in accordance with a preferred embodiment of the present invention.

Referring now to FIG. 2, a schematic block diagram of a rate of penetration sensor assembly 50 is shown. ROP sensor 50 preferably includes an accelerometer 52, a bit rotation detector 54, and a processing unit 56. Processing unit 56 is preferably capable of performing time-based integration and various other mathematical calculations. To perform these calculations, processing unit 56 includes an integrator 58 to perform time based integration calculations. Using time based integration of data taken over specified periods of time, integrator 58 can convert acceleration data into velocity data, and velocity data into position data. Integrator 58 is in communication with a data processor 60 that is capable of receiving the velocity output from integrator 58. While integrator 58 is shown schematically, it should be understood by one of ordinary skill in the art that any mathematical processing unit capable of converting acceleration data into velocity data may be employed. Particularly, the present invention is not limited to devices operating on principles of differential calculus, but also may include algebraic or geometrical methodology to convert the data received from accelerometer 52 into velocity data.

Furthermore, processing unit 56 preferably includes a triggering device 62 in communication with data processor 60 and rotation detector 54. Triggering device 62 receives rotational data concerning the rotation of drill string 10 relative to formation 5 from rotation detector 54 and notifies data processor 60 that drillstring 10 has stopped rotating. Once "triggered", data processor 60 calculates a velocity correction factor that is to be used to correct measured velocity. Because the rate of penetration (and the corresponding acceleration data) of drillstring 20 is relatively slow, the effect of gravity on accelerometer 52 can make a significant difference in the calculated rate of penetration. Furthermore, because of directional drilling technology currently employed in today's subterranean wells, the magnitude and direction of gravity relative to any measurement axis of accelerometer 52 will change as bit 12 proceeds through formation 5.

The correction of rate of penetration data can occur by accounting for the gravity offset either with respect to the raw acceleration data, or with respect to the calculated velocity data. For example, when triggered, the processing unit 56 can subtract a raw gravity acceleration factor from the raw acceleration data output by accelerometer 52 before the data is integrated by integrator 58. The corrected acceleration data is then integrated into velocity data by integrator 58 where it is subsequently statistically processed by data processor 60. Alternatively, processing unit 56 can subtract a velocity offset correction factor from integrated data that is output from integrator 58 with data processor 60. Preferably, data processor 60 performs a statistical calculation to velocity data output from integrator 58 to generate a more reliable rate of penetration calculation.

In practice, accelerometer 52 and rotation detector 54 constitute a detector package 64. Detector package 64 may be located in one single body or may be separated such that accelerometer 52 and rotation detector 54 are located in different drillstring 20 components. Preferably, accelerometer 52 is located either within or proximate to drill bit 12 in such manner as to assure that the axis of investigation is the penetration axis Z of FIG. 1. Rotation detector 54 is preferably located proximate to drill bit and is used to detect rotation of drill bit 12. The detection of drill bit 12 can be accomplished through the use of proximity sensors or through a plurality of accelerometers arranged to measure accelerations in a plane normal to axis Z. It should be understood by one of ordinary skill that rate sensor 54 can be of any type known in the art.

Particularly, rotation detectors 54 often have maximum limits for measuring drilling apparatus 10 RPM's. One way to increase the sensitivity of rotation detectors 54 is to incline the measurement axes to the rotational axis by an angle $\lambda$, thereby allowing the sensors to sense a component of rotation times $\cos(\lambda)$. By mounting the axes in a plane and at $+\lambda$ and $-\lambda$, both sensors measure the same component of drillstring RPM. However, they also measure the perpendicular component of any drillstring rotation, but they measure it in opposite magnitudes. If the two rate signals are added together, the perpendicular component is cancelled leaving just the drill string RPM. Therefore, if the rotation detector has a rate limit of X, then they can be used to measure drill string rates up to X divided by $\cos(\lambda)$, provided the perpendicular rates are small in comparison. Therefore, low rate measurement sensors can be used in environments where the drillstring RPM is higher than their absolute measurement capability.

Output from accelerometer 52 and rotation detector 54 is sent to processing unit 56 where the data therefrom is reduced to a rate of penetration for drillstring 20. To reduce the raw output from accelerometer 52 and rotation detector 54, processing unit 56 generates a correction factor when rotation detector 54 detects zero rotation in drill bit 12 relative to formation. The "window" for determining what constitutes "zero rotation" may change significantly depending on various drilling factors and the composition of formation 5. Processing unit 56 may be programmed to generate the correction factor when the data from rotation detector 54 either indicates no rotation for a particular amount of time, rotation below a determined minimum threshold, or both. For example, a correction factor may be created when rotation is zero for a period of seconds or when rotation is so low that rotation is approximated at zero.

The period of investigation for the zero measurement may also be varied, depending on drilling conditions. Particularly, the correction factor may be generated when the bit fails to rotate for several seconds or for fractions of a second. Presumably, longer delays would be the result of an effort by the operator at the surface to stop drilling momentarily so that processing unit 56 may generate a correction factor. Alternatively, short periods may be used to calculate correction factors during the start and stop nature exhibited by some drill bits in certain formation 5 types.

Nonetheless, when the correction factor is generated, the processing unit 56 preferably subtracts the factor from the accelerometer output (either as raw acceleration data or as processed velocity data) to determine velocity of the drilling system 10 in the direction of axis Z through formation 5. This velocity of drilling system 10 calculated is called the Rate of Penetration.

Finally, the apparatus and method disclosed herein could effectively be used to counter the effects of "bit bounce" on rate of penetration measurements. Bit bounce occurs when the bit encounters a relatively hardened portion of the formation or when other forces from the formation force the bit (and attached drillstring) to "bounce" upward (or in a direction opposite the rate of penetration) abruptly causing much variability in the ROP data. Using the apparatus and methods of the invention herein, any movement in the opposite direction of the axis of interest could be closely monitored and any data from such an event could be selectively factored out of any subsequent ROP calculations. When such an event is detected, any re-calculation of the correction factor can be delayed until the bounce condition is no longer present. Effectively, the apparatus could be configured to "skip" correction factor resets that occur when the bit is "bouncing," opting instead to recalculate the correction factor the next time the bit rotation is zero, when the bit bouncing event has passed.

Numerous embodiments and alternatives thereof have been disclosed. While the above disclosure includes the best mode belief in carrying out the invention as contemplated by the named inventors, not all possible alternatives have been disclosed. For that reason, the scope and limitation of the present invention is not to be restricted to the above disclosure, but is instead to be defined and construed by the appended claims.

What is claimed:

1. A method to measure a rate of penetration along an axis of a drilling assembly into a subterranean formation, the method comprising:

locating an accelerometer proximate to the drilling assembly, the accelerometer configured to transmit acceleration data measured along the axis to a processing unit;

locating a rotation detector proximate to the drilling assembly, the rotation detector configured to transmit velocity data to the processing unit, wherein the velocity data transmitted is the rotational velocity of the drilling assembly relative to the subterranean formation;

integrating the acceleration data against time with the processing unit to yield an axial velocity; and generating a correction factor when the velocity data received by the processing unit indicates a velocity of zero.

2. The method of claim 1 wherein the correction factor generated is a velocity correction factor.

3. The method of claim 2 further comprising subtracting the velocity correction factor from the axial velocity after integrating the acceleration data against time to yield the rate of penetration of the drilling assembly along the axis.

4. The method of claim 1 wherein the correction factor generated is an acceleration correction factor.

5. The method of claim 4 further comprising subtracting the acceleration correction factor from the acceleration data before integrating against time to yield the rate of penetration of the drilling assembly along the axis.

6. The method of claim 1 wherein the velocity is measured about the drilling axis.

7. The method of claim 1 further comprising re-generating the correction factor each time the velocity data received by the processing unit indicates a velocity of zero.

8. The method of claim 7 wherein re-generating the correction factor is halted when a bit-bouncing condition is detected by the accelerometer.

9. The method of claim 1 wherein the velocity of zero is determined by a minimum velocity at a minimum amount of time.

10. The method of claim 1 further comprising statistically processing the axial velocity by subtracting the mean from the acceleration data before integrating the acceleration data against time.

11. The method of claim 1 further comprising delaying the generation of the correction factor while the drilling assembly is undergoing a bit-bouncing condition.

12. An apparatus to measure a rate of penetration along an axis of a drilling assembly into a subterranean formation, the apparatus comprising:

an accelerometer, said accelerometer configured to transmit acceleration data measured along the axis to a processing unit;

a rotation detector, said rotation detector configured to transmit velocity data to the processing unit;

said velocity data including a rotational velocity of the drilling assembly relative to the subterranean formation;

said processing unit configured to integrate the acceleration data against time to produce an axial velocity;

said processing unit configured to generate a velocity correction factor when said rotational velocity is zero; and said processing unit configured to subtract said velocity correction factor from said axial velocity to indicate the rate of penetration of the drilling assembly along the drilling axis.

13. The apparatus of claim 12 wherein said processing unit re-generates said velocity correction factor each time the velocity data received by the processing unit indicates a velocity of zero.

14. The apparatus of claim 13 wherein the velocity of zero is determined by a minimum velocity at a minimum amount of time.

15. The apparatus of claim 12 wherein said processing unit halts the generation of said velocity correction factor when said accelerometer reports that the drilling assembly is experiencing a bit-bouncing condition.

16. An apparatus to measure a rate of penetration along an axis of a drilling assembly into a subterranean formation, the apparatus comprising:

an accelerometer, said accelerometer configured to transmit uncorrected acceleration data measured along the axis to a processing unit;

a rotation detector, said rotation detector configured to transmit velocity data to the processing unit;

said velocity data including a rotational velocity of the drilling assembly relative to the subterranean formation;

said processing unit configured to generate an acceleration correction factor when said rotational velocity is zero; and said processing unit configured to subtract said acceleration correction factor from said uncorrected acceleration data to yield corrected acceleration data;

to indicate the rate of penetration of the drilling assembly along the drilling axis;

said processing unit configured to integrate the corrected acceleration data against time to indicate the rate of penetration of the drilling assembly along the drilling axis.

17. The apparatus of claim 16 wherein said processing unit re-generates the acceleration correction factor each time the velocity data received by the processing unit indicates a velocity of zero.

18. The apparatus of claim 17 wherein the velocity of zero is determined by a minimum velocity at a minimum amount of time.

19. The apparatus of claim 16 wherein said processing unit halts the generation of said acceleration correction factor when said accelerometer reports that the drilling assembly is experiencing a bit-bouncing condition.

* * * * *